US006230334B1

(12) United States Patent
Camp et al.

(10) Patent No.: US 6,230,334 B1
(45) Date of Patent: May 15, 2001

(54) CLEANSING AND FRESHENING UNIT INTENDED FOR SUSPENSION FROM A RIM OF A TOILET BOWL

(75) Inventors: William R. Camp, Reading; David J. Milora, Blue Bell, both of PA (US)

(73) Assignee: Sara Lee/DE N.V., Utrect (NL)

( * ) Notice: Subject to any disclaimer, the term of this patent is extended or adjusted under 35 U.S.C. 154(b) by 0 days.

(21) Appl. No.: 09/552,207

(22) Filed: Apr. 19, 2000

Related U.S. Application Data

(63) Continuation of application No. 09/294,640, filed on Apr. 19, 1999, now abandoned.

(51) Int. Cl.[7] ..... E03D 9/02
(52) U.S. Cl. ..... 4/231
(58) Field of Search ..... 4/231, 230, 227.1, 4/227.4, 227.5

(56) References Cited

U.S. PATENT DOCUMENTS 1,067,472 * 7/1913 Creed ..... 4/231
1,091,265 * 3/1914 Wohlander ..... 4/231
3,529,309 * 9/1970 Leavitt et al. ..... 4/231
3,766,576 * 10/1973 Ancel ..... 4/231
3,946,448 * 3/1976 Sioufy ..... 4/231
4,813,084 * 3/1989 Buechler et al. ..... 4/231

FOREIGN PATENT DOCUMENTS

785315 * 7/1997 (EP) .
WO 99/66139 * 12/1999 (EP) .

* cited by examiner

*Primary Examiner*—Gregory L. Huson
*Assistant Examiner*—Khoa Huynh
(74) *Attorney, Agent, or Firm*—Merchant & Gould P.C.

(57) ABSTRACT

A cleansing and freshening unit having a twofold purpose of spreading a fresh odour in a toilet room and introducing active substances into flushing water with each flush, the unit comprises a holder with unfoldable flexible suspension means for suspending the unit from the rim of a toilet bowl, a reservoir for active substance, such as liquid containing cleansing and air freshening agent, detachably connected to the holder, and a porous mass being arranged in the holder so as to be located in a path of the flushing water when the unit is suspended from the rim of the toilet bowl, said porous mass communicating with the active substance contained in the reservoir. The holder is provided with a connecting nipple suitable for connection to a discharge opening of the reservoir, so that when the unit is suspended from the rim of the toilet bowl the discharge opening is directed downwards, and with a projection part with a length substantially corresponding to the width of the unfolded suspension means plus minus the thickness of the shell of the toilet bowl.

3 Claims, 4 Drawing Sheets

CLEANSING AND FRESHENING UNIT INTENDED FOR SUSPENSION FROM A RIM OF A TOILET BOWL

This is a continuation of U.S. application Ser. No. 09/294,640, filed Apr. 19, 1999, now abandoned.

The invention relates to a cleaning and freshening unit having a twofold purpose of spreading a fresh odour in a toilet room and introducing active substances into flushing water with each flush.

Such a unit is known from European patent application EP-A-0 538 957. A drawback of the known cleansing and freshening unit is that, because in many toilet bowls the rim of the toilet bowl is narrower than the diameter of the bowl itself when the cleansing and freshening unit is suspended from the rim, the unit is not supported by the bowl and will freely move, particularly when the flushing water passes the unit. As a consequence a contact of flushing water with the cleansing and freshening substance in the unit will not always be sufficiently intensive as required for the cleansing of the toilet bowl and the freshening of the toilet room.

Therefore, the object of the invention is to improve the cleansing and freshening unit in this respect. To this end, according to the invention, there is provided a cleansing and freshening unit having a twofold purpose of spreading a fresh odour in a toilet room and introducing active substances into flushing water with each flush, the unit comprising:

- a holder with unfoldable flexible suspension means for suspending the unit from the rim of a toilet bowl;
- a reservoir for active substance, such as liquid containing cleansing and air freshening agent, detachably connected to the holder;
- a porous mass being arranged in the holder so as to be located in a path of the flushing water when the unit is suspended from the rim of the toilet bowl, said porous mass communicating with the active substance contained in the reservoir, wherein said holder is provided with a connecting nipple suitable for connection to a discharge opening of the reservoir, so that when the unit is suspended from the rim of the toilet bowl the discharge opening is directed downwards, and with a projection part with a length "a" substantially corresponding to the width "b" of the unfolded suspension means minus the thickness "c" of the shell of the toilet bowl. The projection part will be measured such that, when the unit is suspended from the rim, the projection part will be supported by the bowl. From a packing point of view it is of advantage when the projection part comprises a hingeble plate-like element. This plate-like element is preferably provided with channels extending from an outer edge to the porous mass. In this embodiment a more regulated flow of water in the direction of the porous mass will be possible.

To clarify the invention, a practically example of the cleansing and freshening unit will be described with reference to the accompanying drawings.

Figure 1:
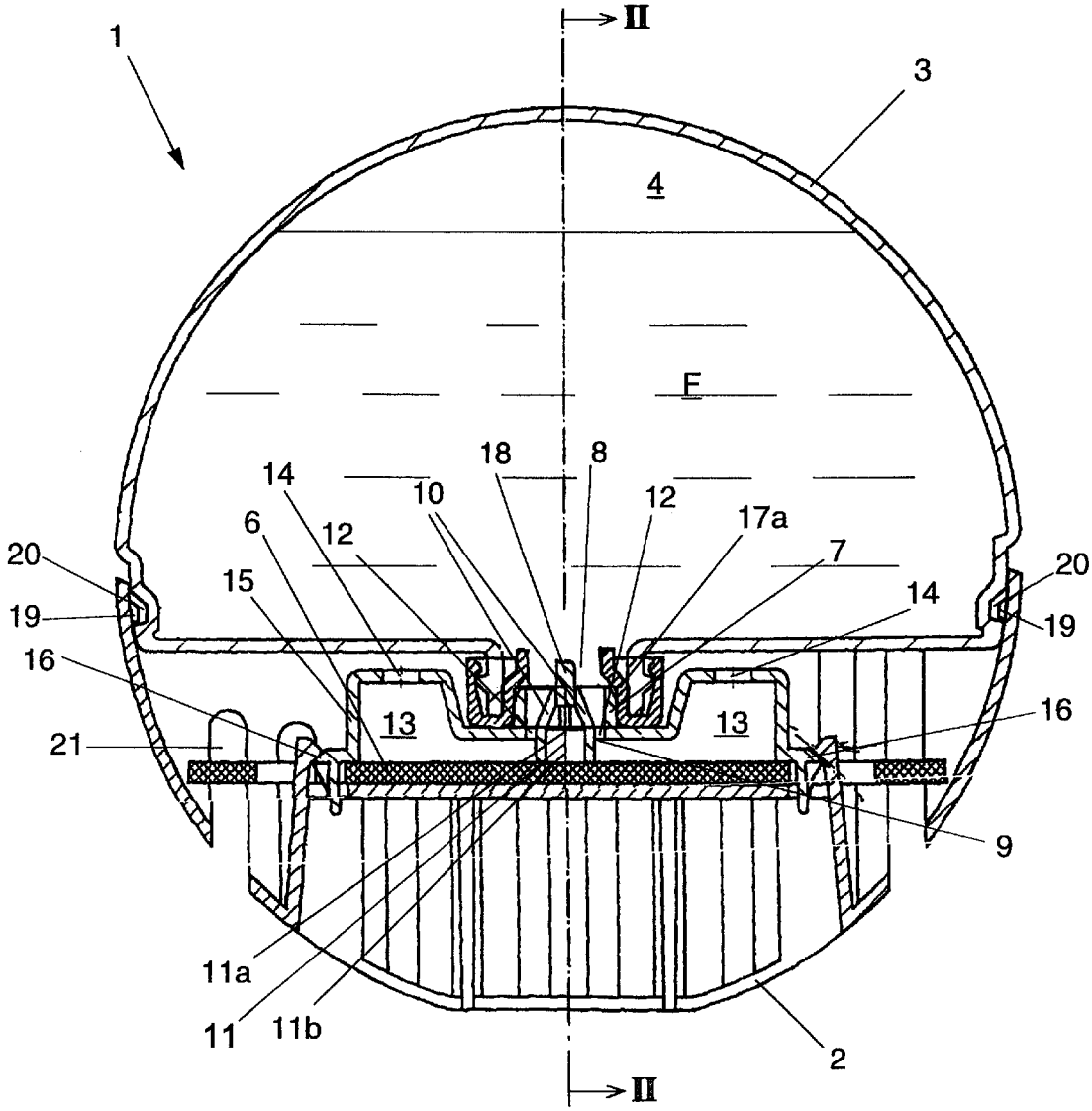
FIG. 1 is a cross-sectional view of an example of embodiment of a cleaning and freshening unit taken along the line I—I of FIG. 2.

The cleaning and freshening unit 1 shown is provided with a holder 2 and a bottle 3 detachably connected to the holder 2 and comprising a liquid reservoir 4. The unit 1 is provided with suspension means 5 for suspending the unit 1 from a rim of a toilet bowl not shown. The unit is also provided with a porous liquid-absorbing mass 6 which always communicates with liquid F contained in the liquid reservoir 4. The porous mass 6 is arranged in the holder 2 so as to be located in a path of the flushing water when the unit 1 is suspended from the rim of the toilet bowl. The porous mass 6 may be, e.g., a sponge or a plate of sintered porous material.

The holder 2 is provided with a connecting nipple 7 suitable for connection to a discharge opening 8 of the bottle 3, so that when the unit 1 is suspended from the rim of the toilet bowl the discharge opening 8 is directed downwards. Of course, the bottle 3 is of such construction that the discharge opening 8 is located at the lowermost point of the bottle 3, so that all liquid F can flow from the liquid reservoir 4 outwards via the discharge opening 8.

According to the invention the discharge opening 8 of the bottle 3 when connected to the connecting nipple 7 is partly cloned by a closing wall 9 provided with at least one liquid passage opening 10 which opens into an inlet 11*a* of a channel 11 abutting with an outlet 11*b* having a limited surface against the porous mass 6, and provided with at least one air supply opening communicating with the ambient pressure. The sizes of the at least one liquid passage opening 10 and the at least one air supply opening are so adjusted to each other and to the viscosity of the liquid F contained in the liquid reservoir 4 that the liquid pressure on the porous mass 6 is always substantially equal and independent of the liquid level in the liquid reservoir 4.

In the present example of embodiment the air supply openings 12 communicate with the ambient pressure via a chamber 13 provided on the side facing upwards with at least one ventilating opening 14. Preferably, the volume of the chamber 13 is such that it can take up at least the volume variations occurring as a result of temperature fluctuations in air contained in the liquid reservoir 4. Thus, liquid is prevented from flowing outwards and being lost owing to a rise in the pressure in the liquid reservoir 4. Moreover, the liquid reservoir 4 is prevented from continuing to drain as a result of capillary action, so that the liquid reservoir 4 would not be empty within a short time. The ventilation openings 14 are preferably located at a higher level than the air supply openings 12. When the air pressure in the liquid reservoir 4 falls, a portion of the liquid contained in the chamber 13 is drawn back again into the liquid reservoir 4. This drawing back will continue until the liquid level in the chamber has fallen so much that there is again a direct air communication between the ventilation opening 14 and the air supply openings 12.

Figure 2:
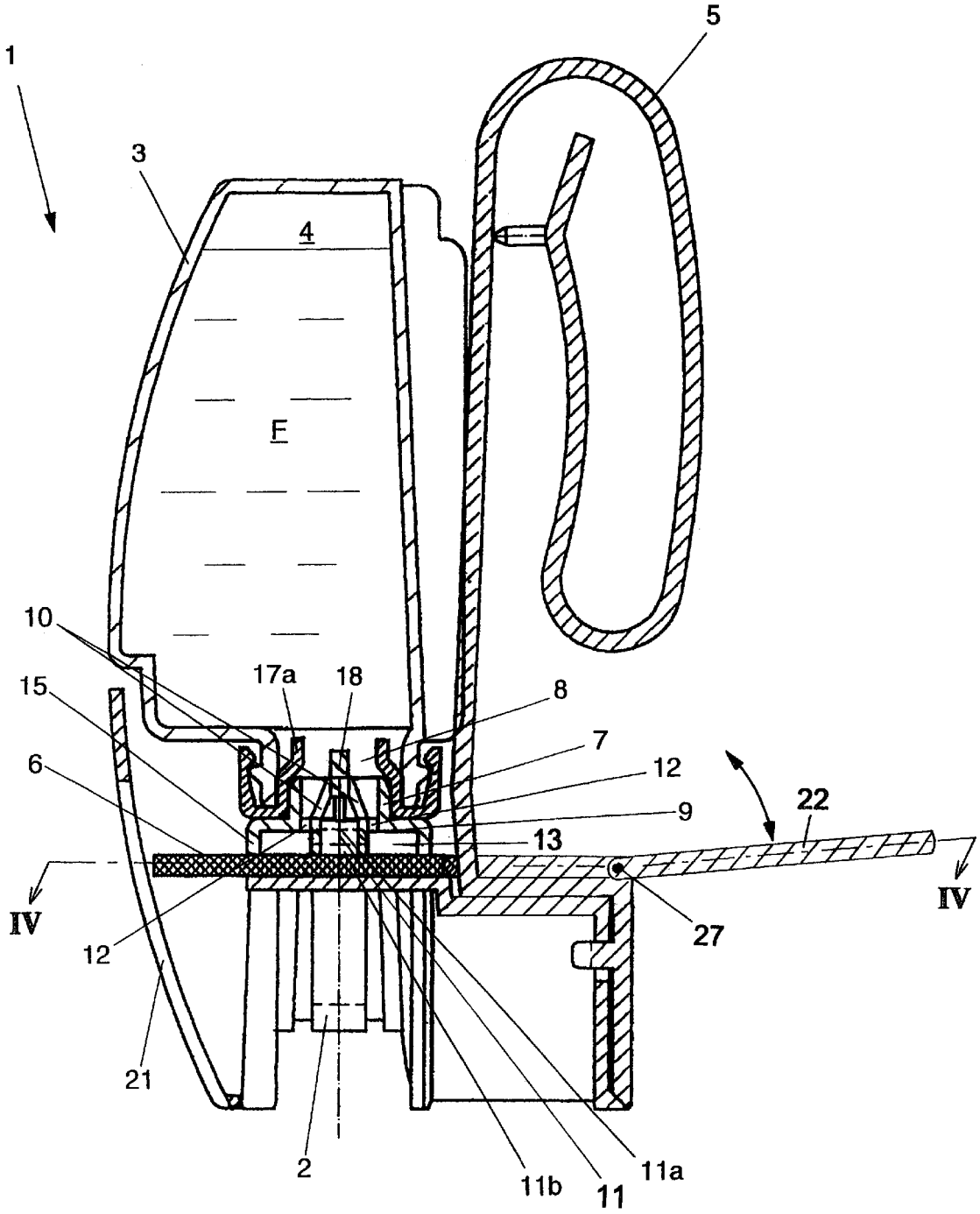
FIG. 2 is a cross-sectional view taken along the line II—II of FIG. 1.

As clearly shown in FIGS. 1 and 2, the holder 2 is made of a first moulded piece of which the unfoldable flexible suspension means 5 form part as well. In FIGS. 1 and 2 it is moreover clearly visible that the connecting nipple 7, the closing wall 9, the at least one liquid passage opening 10, the at least one air supply opening 12, the channel 11, and the walls 15 bounding the chamber 13 form part of a second moulded piece detachably connected to the first moulded piece via a snap connection 16. The porous mass 6 is fixed between the first moulded piece and the second moulded piece. In the present example of embodiment the porous mass is a plate-shaped element of sintered material.

Figure 3:
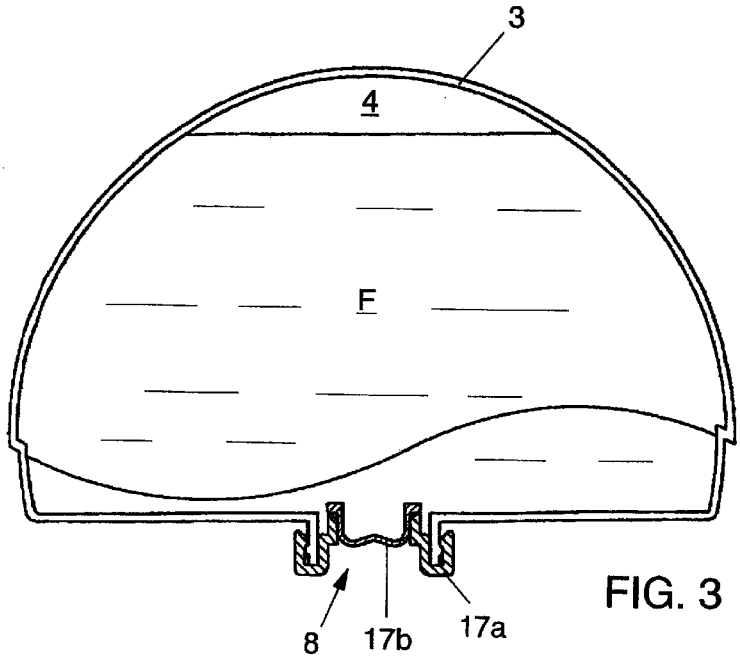
FIG. 3 shows the separate bottle forming part of the cleaning and freshening unit in closed condition.
Figure 4:
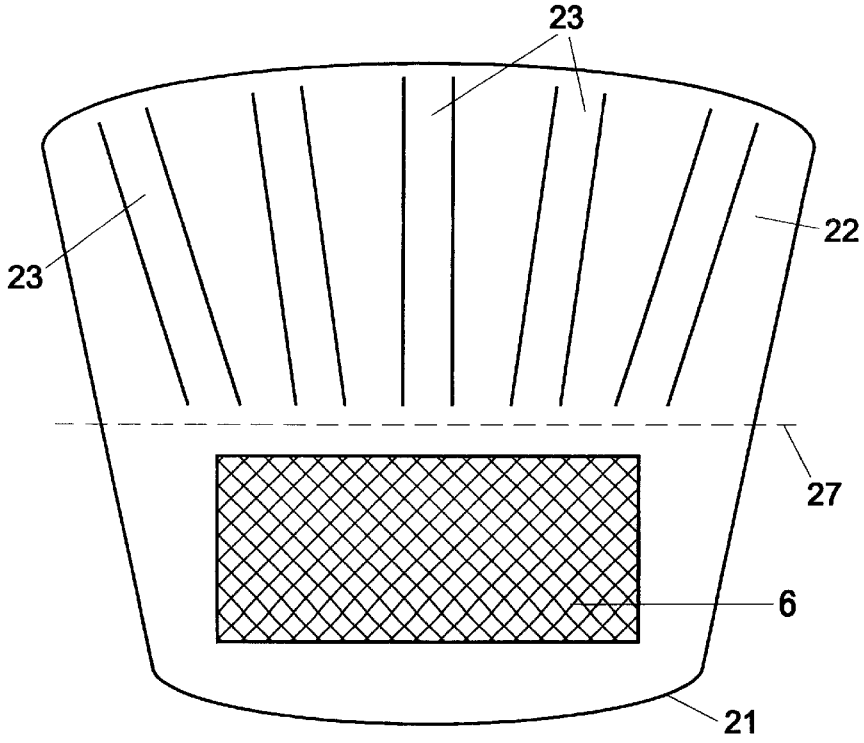
FIG. 4 is a cross-sectional view taken along the line IV—IV of FIG. 2.

As is clearly shown in FIG. 3, the discharge opening 8 of the bottle 3 is closed by a closing cap 17 provided with a first cap portion 17*a* and a second cap portion 17*b*. The second cap portion 17*b* is of such construction that when the bottle is placed on the holder 2 this second cap portion is pressed by a projection 18 provided on the holder 2 into the liquid reservoir 4, so that the bottle 3 is opened and the discharge opening 8 is formed. Thus, it is achieved that when the bottle 3 is placed in the holder 2 the bottle is opened simultaneously. The second cap portion 17*b* preferably has a specific mass smaller than that of the liquid F, so that it begins to float. It is self-evident that the bottle 3 with the liquid F contained therein will be separately available. The bottle 3 and the holder 2 are provided with projections 19 and grooves 20 which cooperate with each other in a manner such that the bottle 3 can be snapped on the holder 2. Moreover, the holder 2 is provided with a number of slots 21 which increase the access of flushing water to the porous mass 6 and, moreover, give the ambient air free passage to the porous mass 6, which enhances the evaporation of the volatile substances in the liquid and the spreading of the substances. In a flushing operation a portion of the active liquid F contained in the porous mass 6 will enter the flushing water and performing its cleaning action therein, while after the flushing operation a portion of the active substance evaporates from the porous mass 6 and effects the freshening action on the surroundings.

Figure 5:
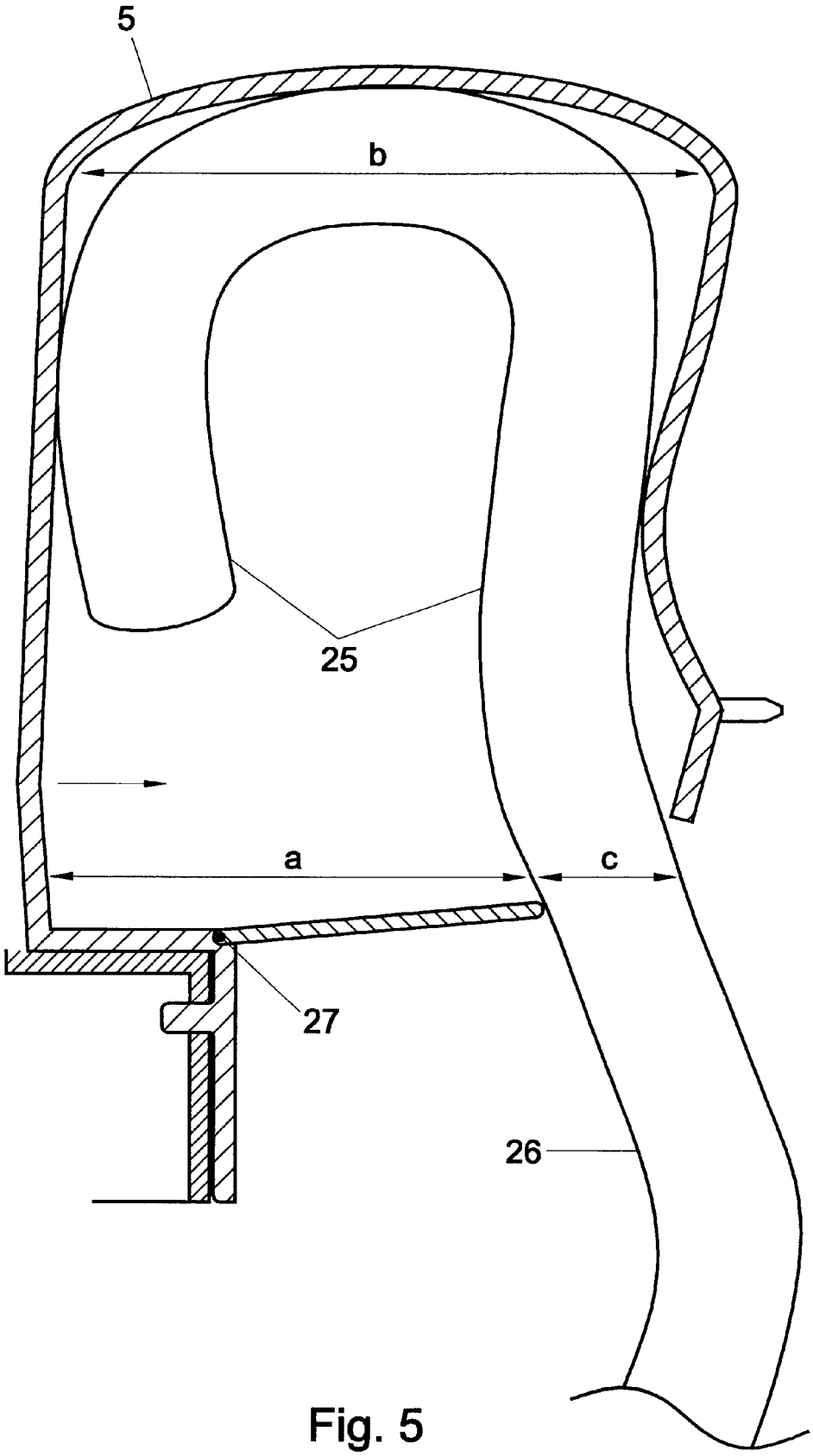
FIG. 5 is part of the view in FIG. 2 with unfolded suspension means.

The described cleansing and freshening unit is further provided with a projection part with a foldable plate-like element 22 (FIGS. 2 and 5), hingeble with respect to the hinge pin 27. When the suspension means are unfolded and the unit is suspended from a rim 25 of a toilet bowl 26, as illustrated in FIG. 5, the unfolded plate-like element 22 is supported by the bowl 26. The plate-like 22 element is provided with channels 23 extending from an outer edge 24 to the porous mass 6. By means of the plate-like element 22 a specified distance "a" between the toilet bowl 26 and the holder 2 is obtained; this distance will be such that the cleansing and freshening unit, when suspended from the rim 25 of the toilet bowl, will support against the inner wall of the bowl 26 itself. This will be the case when the distance "a" corresponds with the width "b" of the unfolded suspension means minus the thickness of the toilet bowl 26. Further by means of the plate-like element a better regulation of the flushing water in the direction of the porous mass 6 will be obtained, particularly when the plate-like element is provided with the channels 23.

It is clear that the invention is not limited to the described embodiment, but that various modifications are possible within the scope of the invention. In this respect it may be noticed that the shape of the projection, particularly that of the plate-like element, may have any form suitable to obtain a support of the cleansing and freshen unit against the wall of a toilet bowl. Also, the form and the number of channels in the plate-like element can be chooses arbitrary.

What is claimed is:

1. A cleansing and freshening unit having a twofold purpose of spreading a fresh odour in a toilet room and introducing active substances into flushing water with each flush, the unit comprising:

a holder with unfoldable flexible suspension means for suspending the unit from a rim of a toilet bowl;

a reservoir for active substances detachably connected to the holder;

a porous mass being arranged in the holder so as to be located in a path of the flushing water when the unit is suspended from the rim of the toilet bowl, said porous mass communicating with the active substance in the reservoir, wherein said holder is provided with a connecting nipple suitable for connection to a discharge opening of the reservoir, so that when the unit is suspended from the rim of the toilet bowl the discharge opening is directed downwards, and with a projection part with a length "a" substantially corresponding to a width "b" of the unfolded suspension means minus a thickness "c" of the shell of the toilet bowl, wherein the projection part comprises a foldable plate-like element having channels extending from an outer edge to the porous mass.

2. A cleansing and freshening unit as claimed in claim 1, wherein the active substances are selected from the group consisting of liquid cleansers, air freshening agents, and a combination of a liquid cleanser and an air freshening agent.

3. A cleansing and freshening unit as claimed in claim 1, wherein the foldable plate-like element is supported by the toilet bowl.

* * * * *